US006669021B1

(12) United States Patent
Spielman

(10) Patent No.: US 6,669,021 B1
(45) Date of Patent: Dec. 30, 2003

(54) PREWRAPPED GIFT PACKAGE

(75) Inventor: Andrew W. Spielman, Sunrise, FL (US)

(73) Assignee: HP Intellectual Corp., Wilmington, DE (US)

( * ) Notice: Subject to any disclaimer, the term of this patent is extended or adjusted under 35 U.S.C. 154(b) by 0 days.

(21) Appl. No.: 10/346,901

(22) Filed: Jan. 17, 2003

(51) Int. Cl.[7] ..... B65D 73/00

(52) U.S. Cl. ..... 206/457; 206/459.5; 206/497; 40/312

(58) Field of Search ..... 206/232, 457, 206/497, 525, 459.5, 575; 40/312; 229/118

(56) References Cited

U.S. PATENT DOCUMENTS

| | | | | | |
|---|---|---|---|---|---|
| 4,726,509 | A | * | 2/1988 | Fonas | 206/457 |
| 5,251,759 | A | * | 10/1993 | Gannon et al. | 206/232 |
| 5,392,983 | A | * | 2/1995 | Clarke-Bolling et al. | 206/457 |
| 5,490,597 | A | * | 2/1996 | Schluger | 206/575 |
| 6,347,703 | B1 | * | 2/2002 | Betts | 206/457 |
| 6,405,869 | B1 | * | 6/2002 | Whittemore et al. | 206/497 |

* cited by examiner

*Primary Examiner*—Luan K. Bui
(74) *Attorney, Agent, or Firm*—Barry E. Deutsch

(57) ABSTRACT

A prewrapped gift package comprises a carton for holding the gift, wrapping paper overlying an outer surface of the carton, and a sleeve providing indicia describing the gift and affixed to a portion of the wrapping paper. A protective outer wrap surrounds the carton, wrapping paper and sleeve.

6 Claims, 2 Drawing Sheets

PREWRAPPED GIFT PACKAGE

BACKGROUND OF THE INVENTION

This invention relates to a prewrapped gift package, and in particular, to a prewrapped gift package which can accommodate different categories of gifts.

During gift giving occasions such as Christmas, birthdays, Mother's Day, and Father's Day, a laborious and time consuming chore is the wrapping of a gift. Many retail establishments offer to gift wrap packages for their customers. However, when it is a gift giving season such as Christmas, the lines to obtain gift wrapping from a retail establishment are long and there is usually an extra charge to have a package gift wrapped.

Accordingly, it is an object of the present invention to provide a prewrapped gift package.

SUMMARY OF THE INVENTION

The foregoing object and other objects of the invention are attained in a prewrapped gift package comprising a carton for holding the gift. Wrapping paper overlays an outer surface of the carton. A sleeve providing indicia identifying the gift is affixed to a portion of the wrapping paper. A protective outer wrap surrounds the carton, wrapping paper and sleeve. The invention also includes a method of forming a prewrapped gift package comprising the steps of forming the carton to hold a gift, placing gift-wrapping paper about the outer surface of the carton, placing a sleeve providing identifying indicia for the gift about a portion of the outer surface of the gift wrapping paper and then placing a protective outer wrap about the carton, wrapping paper and sleeve.

DESCRIPTION OF THE PREFERRED EMBODIMENT

Figure 1:
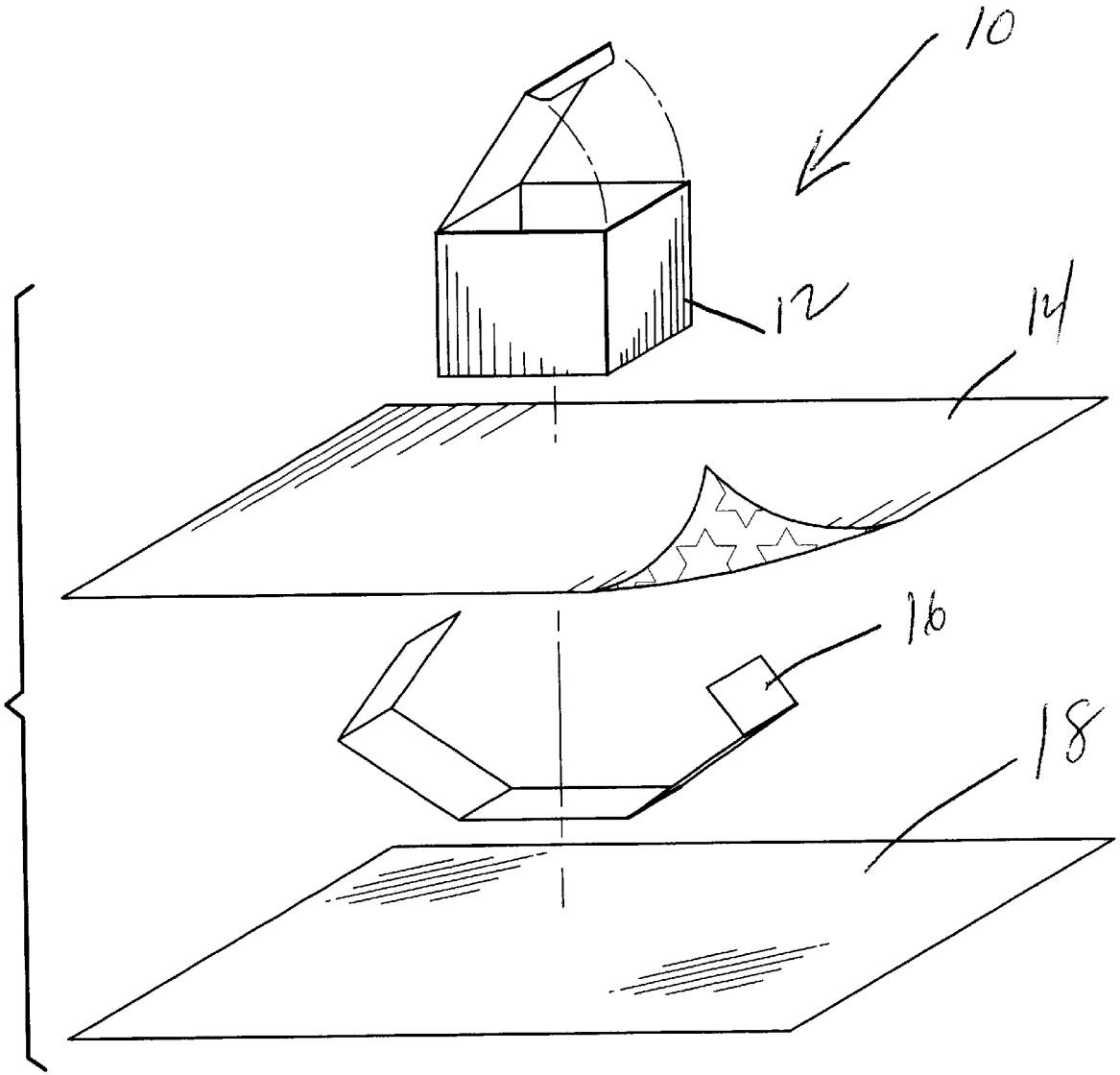
FIG. 1 is an exploded perspective view of a prewrapped gift package.

Referring now to the drawing, there is disclosed a preferred embodiment of the present invention. In referring to the various figures of the drawing, like numerals shall refer to like parts.

The prewrapped gift package 10 includes a carton 12 for holding a gift. The gift may be any product that can fit readily into a relatively small carton to be carried by the purchaser. Such gift may include small electric appliances such as food processors, coffeemakers, steam irons, and the like.

Festive wrapping paper 14 is placed about the outer surface of the carton. The wrapping paper may be of any type and may specifically be designed for association with a gift-giving season such as Christmas, Mother's Day, or the like.

Figure 2:
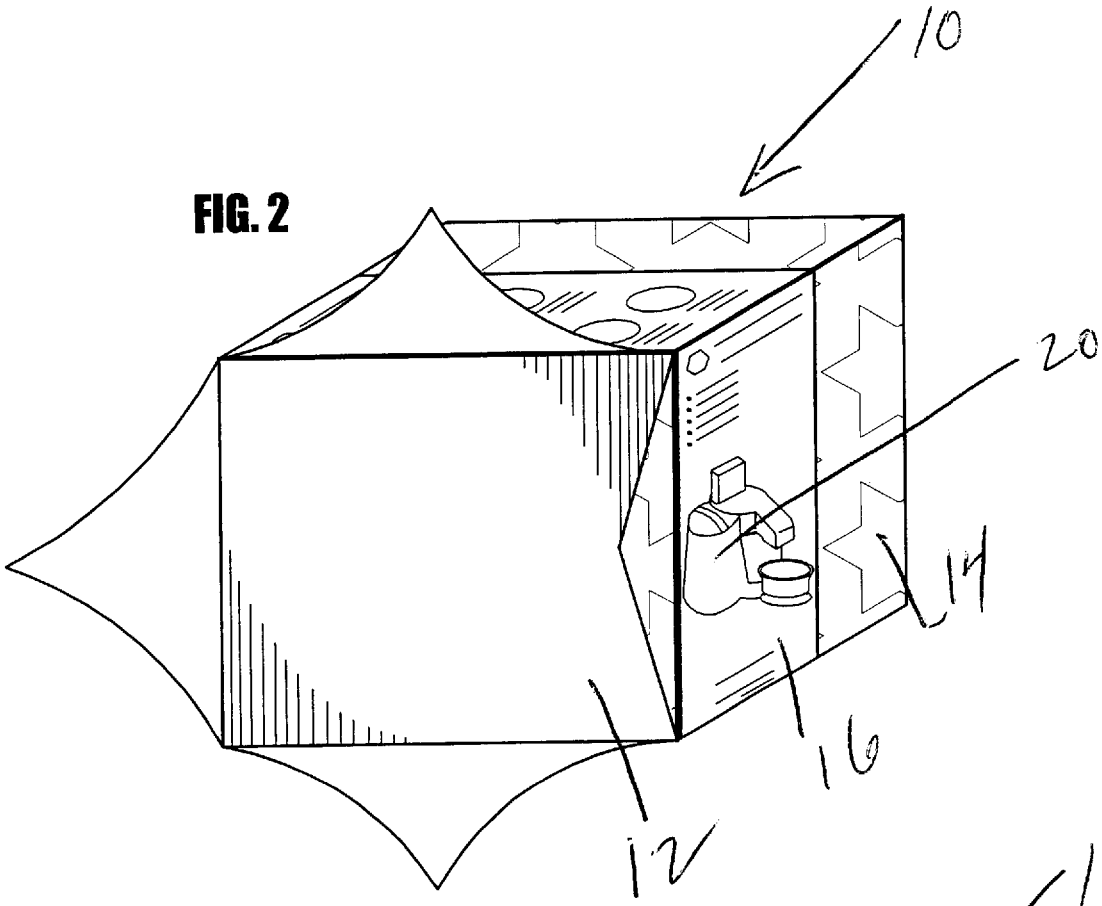
FIG. 2 is a perspective view that illustrates a prewrapped gift package in a partially completed state.
Figure 3:
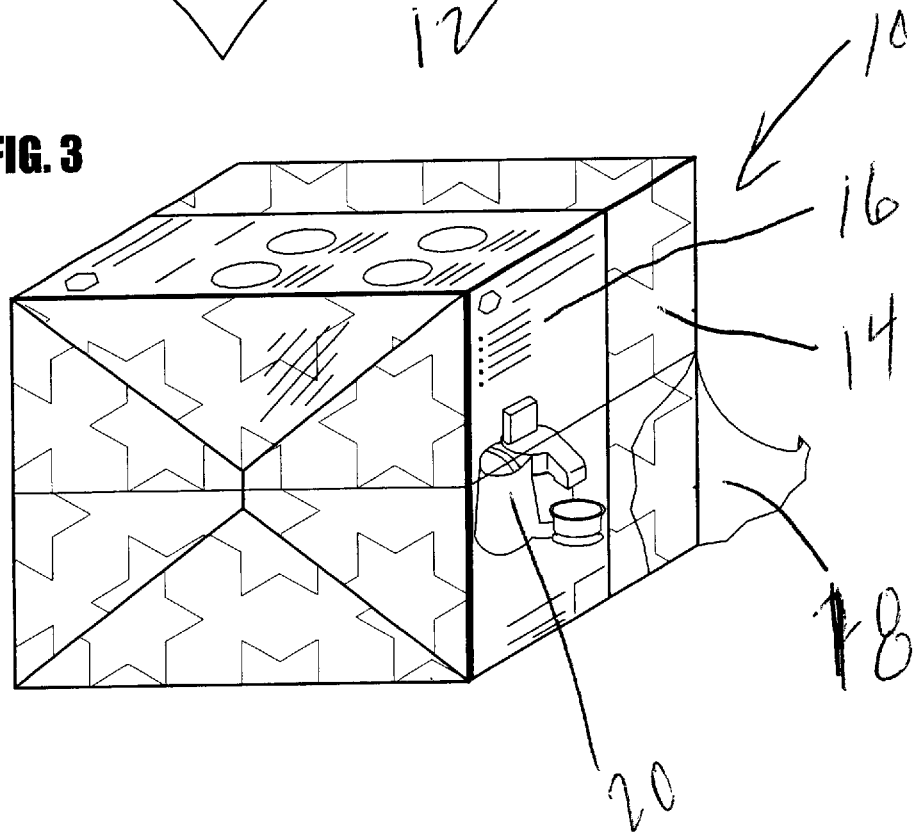
FIG. 3 is a perspective view of a prewrapped gift package in substantially a complete state.

A sleeve 16 is placed over a portion of the outer surface of the wrapping paper. The sleeve includes indicia identifying the gift found within the carton. Sleeves to identify different types of products can be readily interchanged so that the same size carton and identical gift-wrapping paper can be used with different categories of products. Only the sleeve requires changing to identify the specific product found within the carton. As shown in FIGS. 2 and 3, sleeve 16 includes indicia 20 identifying the product intended as a gift as a food processor. Sleeve 16 is self-locking to affix the sleeve about wrapping paper 14. In lieu of sleeve 16, a label may be used which would be glued or otherwise affixed to paper 14.

Finally, an outer protective layer 18 is placed about the carton, wrapping paper and sleeve. The outer protective layer may comprise a plastic film shrink-wrapped about the carton, wrapping paper, and sleeve.

The entire prewrapped gift package may be stacked on shelves for ready removal by a purchaser. The outer layer surrounding the sleeve, wrapping paper, and carton protects the gift-wrapped package from damage.

What is claimed is:

1. A prewrapped gift package comprising:

a carton for holding the gift;

wrapping paper overlying an outer surface of the carton;

a sleeve providing indicia for identifying the gift and affixed to a portion of the wrapping paper; and a protective outer wrap surrounding the carton, wrapping paper, and sleeve.

2. A prewrapped gift package in accordance with claim 1 wherein a small electric appliance is contained in the carton as the gift.

3. A prewrapped gift package in accordance with claim 2 wherein the protective outer wrap comprises a plastic shrink-wrap film.

4. A prewrapped gift package in accordance with claim 1 wherein the protective outer wrap comprises a plastic shrink-wrap film.

5. A method of forming a prewrapped gift package comprising the steps of:

forming a carton to hold the gift;

placing wrapping gift paper about the outer surface of the carton;

placing a sleeve providing identifying indicia for the gift about a portion of the outer surface of the gift wrapping paper; and placing a protective outer wrap about the carton, wrapping paper, and sleeve.

6. A method of forming a prewrapped gift package in accordance with claim 5 further including the step of:

placing a small electric appliance in the carton as the gift.

* * * * *